United States Patent [19]

Weber

[11] 4,148,448

[45] Apr. 10, 1979

[54] TREATMENT LINE FOR METAL WIRE

[75] Inventor: Kurt Weber, Chavannes, Switzerland

[73] Assignee: Maillefer S.A., Switzerland

[21] Appl. No.: 824,619

[22] Filed: Aug. 15, 1977

[30] Foreign Application Priority Data

Aug. 17, 1976 [CH] Switzerland ..... 10449/76

[51] Int. Cl.[2] ..... B65A 49/00

[52] U.S. Cl. ..... 242/128; 242/129

[58] Field of Search ..... 242/128, 129; 266/102

[56] References Cited

U.S. PATENT DOCUMENTS

| | | | |
|---|---|---|---|
| 2,200,140 | 5/1940 | Willeke et al. | 242/128 X |
| 2,242,053 | 5/1941 | Chapman, Sr. | 242/128 |
| 3,131,884 | 5/1964 | Duff | 242/128 |
| 3,321,151 | 5/1967 | Maguire | 242/128 X |

*Primary Examiner*—Roy Lake
*Assistant Examiner*—Paul A. Bell
*Attorney, Agent, or Firm*—Stevens, Davis, Miller & Mosher

[57] ABSTRACT

An installation for treating metal wire, such as for coating a copper conductor, comprises at its upstream end a stationary wire-supply source having a reel support disposed within a loop-guard made of a gray iron or ductile cast-iron part in the form of a hollow body of revolution having an ogival profile. This part bears at its downstream end a conical tip defining the exit aperture for the wire. The inner surface of the loop-guard is machined by turning so as to be absolutely smooth and may also be subjected to a hardening treatment.

7 Claims, 3 Drawing Figures

TREATMENT LINE FOR METAL WIRE

Figure 1:
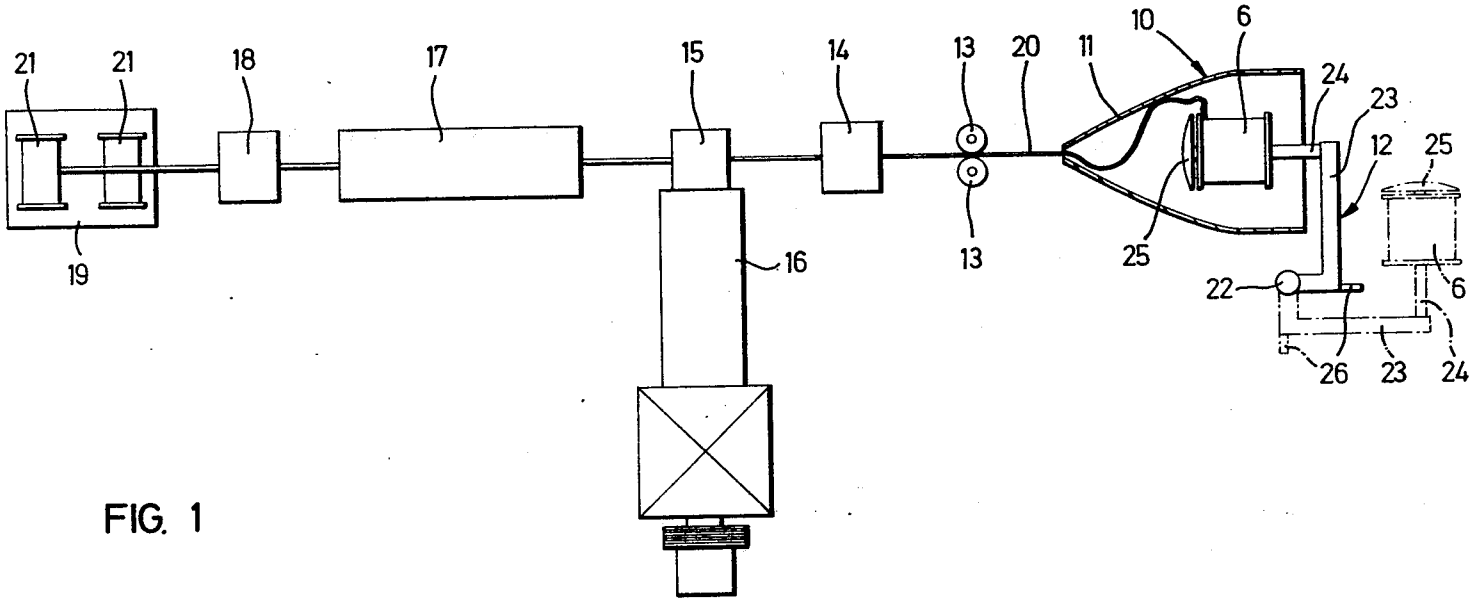

This invention relates to treatment lines for metal wire, of the type having at the upstream end thereof a stationary wire-supply source including a pay-out reel, a cantilevered shaft for supporting the reel, and a loop-guard coaxial with and surrounding the shaft.

The term "treatment line" as used herein designates any installation in which a continuous operation is carried out on metal wire. The present invention relates in particular, however, to lines for treating copper wire, especially wire-drawing lines, heat-treatment lines, or coating lines in which a copper wire is covered with a surface layer or an insulating sheath.

In treatment lines of this type, the use of a stationary supply source, in which the axis of the stored coil of wire coincides with the direction of travel of the wire, has proved advantageous for feeding the wire into the line, for this arrangement makes it possible to use larger pay-out reels than can be used in other supply sources, such as the unwinding type. Furthermore, the braking resistance of the wire as it is uncoiled can be kept very low without the need of any devices for supporting it or of a complicated rotary drive. Finally, the reel supports are of a relatively simple design.

However, it has been realized that the loop-guards currently used with stationary wire-supply sources are no longer suited to the maximum speeds attained nowadays in certain lines for treating metal wire, especially in certain copper wire coating lines and in certain wire-drawing lines.

These conventional loop-guards have hitherto been made of two sheet-metal sections, one cylindrical and the other frusto-conical in shape, welded to one another end to end. Because of irregularities in the sheet-metal, the loop of wire which forms about the pay-out reel inside the loop-guard strikes against certain parts of this guard member, causing localized damage to the wire which results in defects at various locations after treatment. In the case of extrusion lines, for example, in which the wire is coated with a sheath of insulating plastic material, the flats or sectional irregularities produced when the wire strikes against the loop-guard may cause defects in insulation requiring entire sections of wire to be rejected.

In order to remedy the drawbacks of sheet-metal loop-guards, it has already been sought to produce molded, one-piece loop-guards made of plastics, e.g., polyester. These polyester loop-guards have an ogival longitudinal profile in order to regulate the movement of the loop of wire on the inner surface of the loop-guard. However, this solution has proved completely unsuitable, for although the previously-noted damage to the wire is eliminated, the loop-guard itself wears out much more quickly than one made of sheet-metal and must therefore be replaced frequently. Moreover, the use of plastics has resulted in one other drawback: because such material is so light, the rubbing of the wire against the loop-guard causes the latter to vibrate at its resonance frequency, thus producing a well-nigh unbearable noise.

It is an object of this invention to remedy these drawbacks by providing a more efficient loop-guard than those used in the past, and one which makes it possible to improve the quality of production of high-speed treatment lines.

To this end, in the treatment line according to the present invention, of the type initially described, the improvement comprises a loop-guard including a metal part in the form of a hollow body of revolution having an inner profile in the shape of an ogive and a smooth inner surface.

Figures 2, 3:
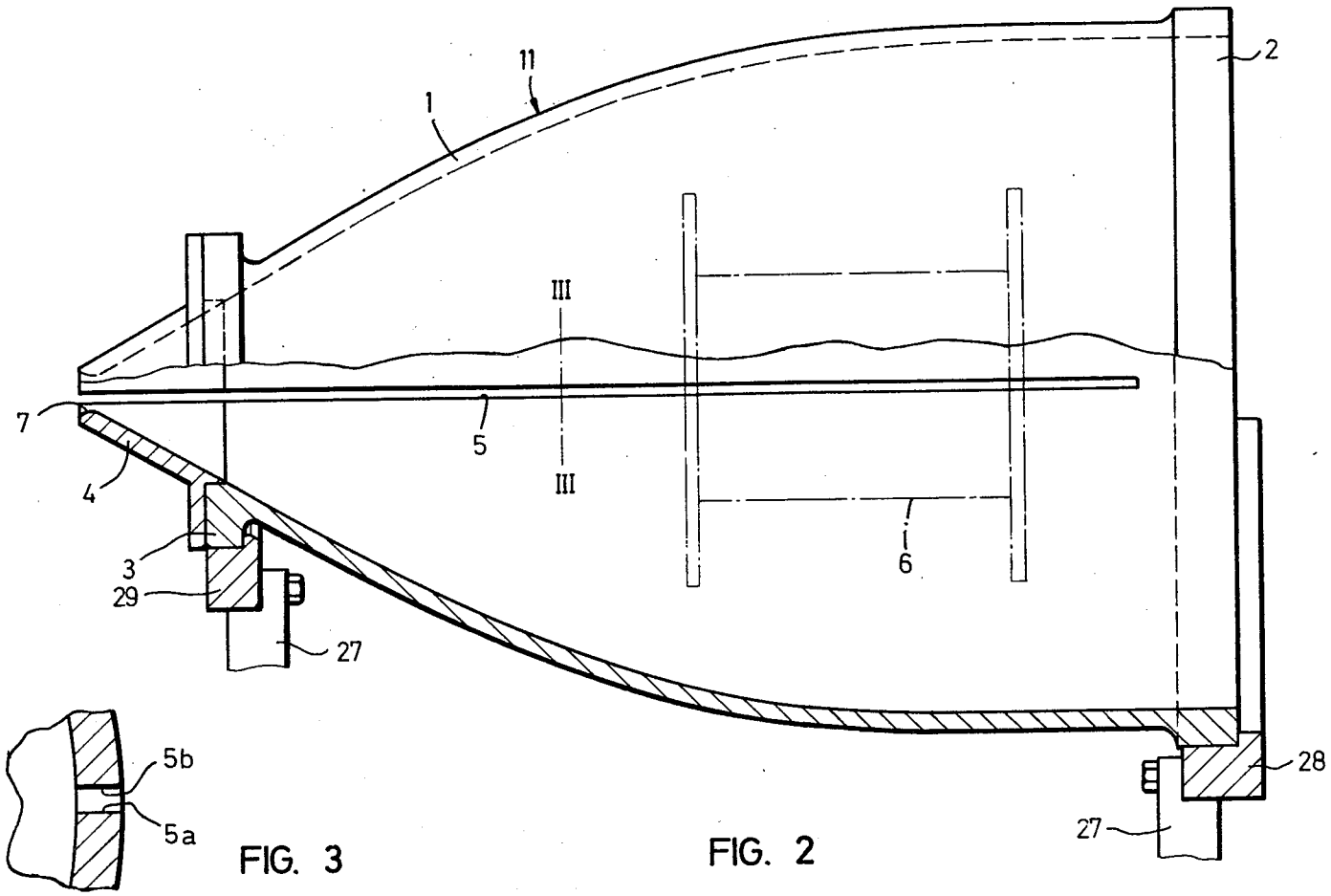

A preferred embodiment of the invention will now be described in detail with reference to the accompanying drawings, in which:

FIG. 1 is a small-scale top plan view of a sheathing line for providing a copper wire with an insulating plastic coating, FIG. 2 is an overall view, partially in elevation and partially in axial section, of a loop-guard, and FIG. 3 is a partial section on a larger scale taken on the line III—III of FIG. 2.

FIG. 1 illustrates diagrammatically, in a top plan view, a treatment line in which a copper wire 20, e.g., a telephone wire, is coated with an insulating sheath while passing through an extrusion head extruding plastic material. The line shown in FIG. 1 comprises at its upstream end a stationary wire-supply source 10 made up essentially of a loop-guard 11 and a pay-out reel support 12. The copper wire 20, which uncoils from a reel 6, passes through the downstream aperture of the loop-guard 11, is guided between two rollers 13, then reaches a withdrawal device 14. Upon leaving the withdrawal device 14, the wire 20 passes into an extrusion head 15 secured to the end of an extruder 16. The wire 20 then passes through a cooling vat 17, is pulled along by a second withdrawal device 18, and arrives at an automatic winding-machine 19 where the wire 20, insulated by a layer of plastic, is wound on one or the other of two take-up reels 21. The apparatus designated by reference numerals 13 to 21, summarily described above, is well, known to those skilled in the art; it may be designed in various ways and need not be described in further detail. It should be noted, moreover, that instead of being an extrusion line, the treatment line might equally well be some other kind of line, e.g., a wire-drawing line or a heat-treatment line.

The stationary wire-supply source composed of the displaceable support 12 and the loop-guard 11 is intended to feed a continuous supply of copper wire to the line. The support 12 takes the form of a bent arm 23 supported on a base in such a way as to be able to pivot about a vertical axis situated in the center of a hinge 22. At its free end, the bent arm 23 bears a fixed shaft 24 having a disc-like member 25 is detachable so that the reel 6 may be mounted on the shaft 24 and secured there by suitable means. Since the shaft 24 is horizontal, and since the displaceable support 12 pivots about the vertical axis of the hinge 22, this assembly is quite easy to move by means of a handle 26 fixed to the bent arm 23.

As may be seen from the drawing, the loop-guard 11 is ogival in shape. The pivoting axis of the support 12 is situated in such a way that the shaft 24 and the disc-like member 25 can be disengaged from the loop-guard 11 by a simple pivoting movement. When the bent arm 23 is in the position of disengagement, as shown in dot-dash lines in FIG. 1, the shaft 24 is directed towards an auxiliary support (not shown) upon which a fresh reel like the reel 6 may be placed. It is thus possible to feed the treatment line continuously by soldering the trailing end of the wire on the reel 6, which is in place within the loop-guard 11, to the leading end of the wire on the replacement reel. This operation will be described further on.

The loop-guard 11 is illustrated in FIG. 2. It comprises a part 1 which may be made of gray iron or of ductile cast-iron, for example, and which takes the form of a hollow body of revolution about its axis, the generatrices of which are curved lines giving the longitudinal profile of the part 1 an ogival shape. At its rearward or upstream end, the part 1 is provided with a reinforcing flange 2, while at its forward or downstream end, there is a flange 3 designed to allow securing of a frustoconical tip 4 which is coaxial with the part 1 and guides the wire 20 at the exit of the loop-guard 11.

The loop-guard 11 further includes a longitudinal slot 5 milled into the cast part; the slot 5 extends along the part 1 for the greater part of its length and is bounded by two plane, parallel, radially-oriented faces 5*a* and 5*b* (FIG. 3). The slot 5 is a few millimeters wide, while the upstream diameter of the part 1 will be from 80 cm. to 1 m., for instance.

The loop-guard 11 is placed upon a fixed base 27 having two inverted arches 28 and 29 upon which the flanges 2 and 3 rest, respectively. The base 27 is situated close to the pivoting support 12, the cantilevered shaft 24 of which is intended to receive the reels 6 carrying the wire 20, e.g., telephone wire. By pivoting the arm 23, the reel 6 can be inserted in the loop-guard 11. The reel 6 then assumes the position shown in dot-dash lines in FIG. 2. As a variation, the support 12 might be replaced by a horizontally movable carriage.

The trailing end of the wire 20 coiled on the reel 6 can be pulled out through the slot 5 and attached to the leading end of the wire 20 coiled on another reel, thus ensuring continuous feeding of the line.

The wire 20 runs out of an aperture 7 at the downstream end of the tip 4. Within the loop-guard 11, it forms a loop (FIG. (1) which rotates at high speed about the axis of the reel 6 and of the part 1.

In order to ensure the advantageous properties of the arrangement described, it is essential not only that the loop-guard 11 be a massive metal part, such as a cast-iron part, but also that the inner surface thereof be as perfect a surface of revolution as possible. To this end, the inner surface of the part 1 described will have been subjected to precision turning. Such precision turning, meeting the specifications of the ISO standard for fine finishing (maximum roughness grade 0.8 microns), can easily be carried out on the cast part in the workshop. It ensures that the wire will run off without being damaged, without wear and tear on the loop-guard, and above all, without noise. As a matter of fact, it has been found that the noise level is reduced even below that associated with sheet-metal loop-guards.

In one particular embodiment, the inner surface of the part 1 was subjected to a sulfinization treatment which improved the qualities of the part 1 even further.

The inner surface might obviously be machined by other tools instead of being turned, and it might be made of some other metal than cast iron.

A loop-guard designed like the loop-guard 11 has proved very advantageous from the economic point of view in stationary wire-supply sources called upon the uncoil a wire a few tenths of a millimeter in diameter at a rate of 2,000 m./min. or more, for example. The increase in speed made possible by the use of a cast loop-guard very quickly amortized the higher cost of this part as compared with a polyester loop-guard.

The slot 5 is preferably made by milling, although other machining methods may also enter into consideration.

The sulfinization treatment mentioned above might also be replaced by some other passivation and/or hardening treatment applied to the inner surface of the part 1 and the tip 4.

A further advantage of the embodiment described is that owing to the milling of the slot 5, the edges thereof evidence neither inner roughness nor any rim liable to damage the loop of wire during its rotation.

What is claimed is:

1. A treatment line for treatment of copper wire at a delivery speed of at least 2,000 m/min, said treatment line comprising at its upstream end:

a stationary wire supply source comprising:

a cantilevered shaft;

a copper wire carrying reel rotatably supported on said shaft; and a loop-guard coaxial with and surrounding said shaft, said loop-guard comprising a cast part of gray or ductile cast iron surrounding said reel, said cast iron part comprising a hollow body with a finely machined and finished smooth and hardened inner surface in the shape of an ogive.

2. A treatment line in accordance with claim 1, wherein said loop-guard further includes a conical tip disposed at the end thereof nearest the apex of said ogive, said tip having a wire-exit aperture at the apex thereof.

3. A treatment line in accordance with claim 1, wherein said cast iron part includes a longitudinal slot having parallel sides, said slot being situated in a horizontal plane level with the axis of said loop-guard.

4. A treatment line in accordance with claim 1, further comprising a fixed base upon which said loop-guard is mounted in such a way that the axis of said loop-guard is horizontal, and a displaceable support member to which the upstream end of said shaft is secured.

5. A treatment line in accordance with claim 4, further comprising means for displacing said support member horizontally and thereby inserting said reel into or withdrawing said reel from said loop-guard.

6. A treatment line for treatment of copper wire at a delivery speed of at least 2,000 m/min, said treatment line comprising at its upstream end:

a stationary wire supply source comprising:

a cantilevered shaft;

a copper wire carrying reel rotatably supported on said shaft; and a loop-guard coaxial with and surrounding said shaft, said loop-guard comprising a cast part of gray or ductile cast iron surrounding said reel, said cast iron part comprising a hollow body with a finely machined and finished smooth and hardened inner surface in the shape of an ogive, said loop-guard further comprising:

a first substantially circular flange extending radially outwardly from one end thereof;

a second substantially circular flange extending radially outwardly from a region adjacent the other end thereof adjacent the apex of the ogive; and a frustoconical tip defining the apex of the ogive, said tip having a circular flange extending radially outwardly which abuts and mates with said second flange; and a stationary base comprising first and second inverted arches on which rest said first and second flanges respectively.

7. A treatment line as claimed in claim 6, further comprising:

an L-shaped arm pivotally mounted at one end thereof about a second axis substantially perpendicular to the axis of the shaft, said shaft being mounted on the other end of said arm whereby said reel is moved into and out of said loop-guard by pivoting said arm about said second axis.

* * * * *